US009353482B2

(12) United States Patent
Graff et al.

(10) Patent No.: US 9,353,482 B2
(45) **Date of Patent: *May 31, 2016**

(54) WATER-DEGRADABLE PAPER SHEET, AND TUBE FOR A PAPER ROLL CONSISTING OF SUCH A SHEET

(71) Applicant: SCA TISSUE FRANCE, Saint-Ouen (FR)

(72) Inventors: Pierre Graff, Wolfgantzen (FR); Veronique Wiss, Hessenheim (FR); Remy Ruppel, Durrenentzen (FR); Pierre Probst, Ammerschwihr (FR)

(73) Assignee: SCA TISSUE FRANCE, Saint-Ouen (FR)

( * ) Notice: Subject to any disclaimer, the term of this patent is extended or adjusted under 35 U.S.C. 154(b) by 0 days.

This patent is subject to a terminal disclaimer.

(21) Appl. No.: 14/274,036

(22) Filed: May 9, 2014

(65) Prior Publication Data

US 2014/0246161 A1 Sep. 4, 2014

Related U.S. Application Data

(62) Division of application No. 13/139,952, filed as application No. PCT/EP2009/067270 on Dec. 16, 2009, now Pat. No. 8,758,564.

(30) Foreign Application Priority Data

Dec. 18, 2008 (FR) ..... 08 58807

(51) Int. Cl.
*D21H 17/28* (2006.01)
*A47K 10/16* (2006.01)
(Continued)

(52) U.S. Cl.
CPC ..... *D21H 17/28* (2013.01); *A47K 10/16* (2013.01); *B31C 1/00* (2013.01); *B65H 75/10* (2013.01); *B65H 2701/522* (2013.01); *D21H 27/42* (2013.01); *Y10T 428/1307* (2015.01)

(58) Field of Classification Search
CPC ..... A47K 10/16; A47K 10/18; A47K 10/22; B65H 2701/522; B65H 2701/5112; D21H 27/002; D21H 17/24; D21H 17/28; D21H 17/29; B31C 1/00
USPC ..... 162/175; 604/364, 375; 428/34.2, 34.3, 428/35.7, 36.4; 493/269, 272, 273, 275, 493/960; 206/390
See application file for complete search history.

(56) References Cited

U.S. PATENT DOCUMENTS 1,761,111 A * 6/1930 Doty ..... 106/160.1
1,824,421 A 9/1931 Allen
(Continued)

FOREIGN PATENT DOCUMENTS

DE 4431755 A1 3/1996
EP 0372388 A2 6/1990
(Continued)

OTHER PUBLICATIONS

PCT International Search Report issued Jun. 7, 2010 for International Application No. PCT/EP2009/067270; International Filing Date: Dec. 16, 2009; 6 pages.
(Continued)

*Primary Examiner* — Eric Hug
(74) *Attorney, Agent, or Firm* — Drinker Biddle & Reath LLP

(57) ABSTRACT

A water degradable paper sheet has a basis weight of 80 to 400 g/m$^2$ and is dry-formed from paper fibers bound together by a water-soluble binder including starch, the amount of binder in the sheet being 30 to 70%. Additionally, a tube is formed by a cylinder having a wall that includes at least one dry-formed paper sheet including paper fibers bound together by a water-soluble binder.

10 Claims, 1 Drawing Sheet

(51) Int. Cl.

| | |
|---|---|
| ***B31C 1/00*** | (2006.01) |
| ***B65H 75/10*** | (2006.01) |
| *D21H 27/42* | (2006.01) |

(56) References Cited

U.S. PATENT DOCUMENTS

| | | | | |
|---|---|---|---|---|
| 3,580,253 | A | 5/1971 | Bernardin | |
| 4,473,368 | A | 9/1984 | Meyer | |
| 5,242,545 | A | 9/1993 | Bradway et al. | |
| 5,576,364 | A | 11/1996 | Isaac et al. | |
| 5,736,209 | A | 4/1998 | Andersen et al. | |
| 6,168,857 | B1 | 1/2001 | Andersen et al. | |
| 6,200,404 | B1 | 3/2001 | Andersen et al. | |
| 6,818,101 | B2 | 11/2004 | Vinson et al. | |
| 7,951,440 | B2 * | 5/2011 | Butler, III | 428/36.9 |
| 8,075,699 | B2 | 12/2011 | Butler, III | |
| 2002/0084045 | A1 | 7/2002 | Collias et al. | |
| 2002/0096287 | A1 | 7/2002 | Jewell et al. | |
| 2006/0037724 | A1 | 2/2006 | Akai et al. | |
| 2007/0048474 | A1 | 3/2007 | Butler et al. | |
| 2009/0075001 | A1 * | 3/2009 | O'Neill | 428/35.7 |
| 2011/0287273 | A1 | 11/2011 | Weisang et al. | |
| 2012/0035526 | A1 | 2/2012 | Colin et al. | |
| 2012/0089075 | A1 | 4/2012 | Colin et al. | |

FOREIGN PATENT DOCUMENTS

| | | | |
|---|---|---|---|
| EP | 0415385 | A1 | 3/1991 |
| EP | 0438672 | A1 | 7/1991 |
| EP | 1459876 | A2 | 9/2004 |
| GB | 691552 | A | 5/1953 |
| GB | 2202750 | * | 10/1988 |
| GB | 2202750 | A | 10/1988 |
| GB | 2401870 | * | 11/2004 |
| JP | S62211029 | A | 9/1987 |
| JP | 2005089911 | A | 4/2005 |
| WO | WO-0006462 | A1 | 2/2000 |
| WO | WO 00/44982 | * | 8/2000 |
| WO | WO-0121121 | A1 | 3/2001 |
| WO | WO-0174939 | A1 | 10/2001 |
| WO | WO 02/47998 | * | 6/2002 |
| WO | WO-0247998 | A1 | 6/2002 |

OTHER PUBLICATIONS

PCT Written Opinion issued Jun. 7, 2010 for International Application No. PCT/EP2009/067270; International Filing Date: Dec. 16, 2009; 11 pages.

English Translation of the Written Opinion of the International Searching Authority Issued in PCT/IB/2010/002190 on Feb. 24, 2011 (8 pages).

PCT International Search Report for International Application No. PCT/IB/2010/002190, International Filing Date: Jun. 11, 2010; Date of Mailing: Feb. 24, 2011, 3 pages.

France Search Report for Application No. 09 03827; filing datre Aug. 3, 2009; Completion date, Feb. 25, 2010; 2 pages.

English Translation of the Written Opinion of the International Searching Authority Issued in PCT/IB/2010/002165 on May 19, 2011.

PCT International Search Report for International Application No. PCT/IB/2010/002165, International Filing Date: Jun. 11, 2010; Date of Mailing: Feb. 25, 2011, 4 pages.

PCT International Search Report and Written Opinion for the International Application No. PCT/EP2009/067324, mailed Apr. 19, 2010.

* cited by examiner

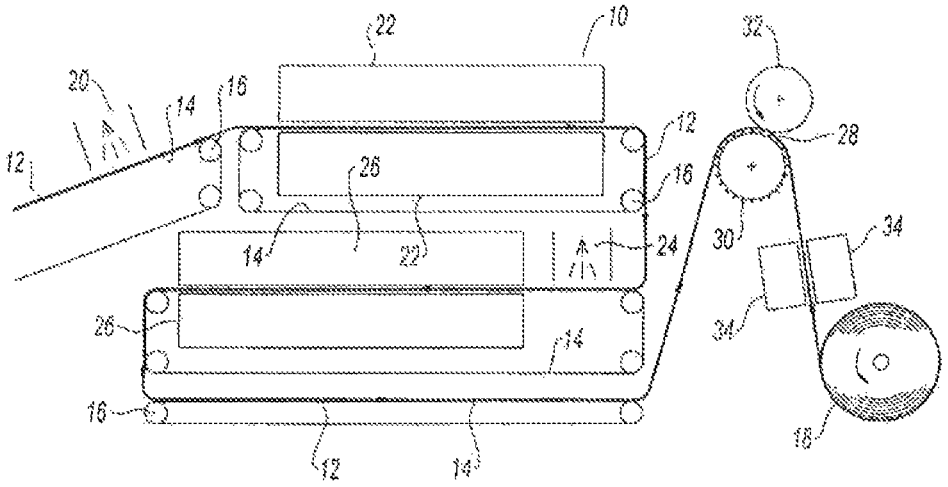
22
10
32
20
14
16
12
28
12
26
16
30
34
14
22
24
26
14
34
16
12
14
18

WATER-DEGRADABLE PAPER SHEET, AND TUBE FOR A PAPER ROLL CONSISTING OF SUCH A SHEET

This application is a Divisional of application Ser. No. 13/139,952, filed Aug. 4, 2011, which is the National Stage of International Application No. PCT/EP2009/067270 filed Dec. 16, 2009, and claims benefit of French Application No, 0858807 filed Dec. 18, 2008, which are herein incorporated by reference in their entirety.

BACKGROUND OF THE INVENTION

The present disclosure relates to a paper sheet which can disintegrate in water and to its use in the manufacture of a roll tube; it relates to the field of products composed of a strip of flexible sheet material wound around a tube. It is targeted in particular at the field of paper for sanitary or domestic use in tube-comprising rolls.

Paper for sanitary or domestic use, such as toilet paper, paper wipes or kitchen roll, is packaged, for some, as tube-comprising rolls.

The tube is a cylinder, generally made of cardboard, which is discarded after the paper of the roll has been consumed. The tube fulfils several functions:

It acts as support onto which the paper sheet is wound during the manufacture of the roll. Generally, the rolls are manufactured from a very wide mother sheet which is wound around a tubular member of corresponding length, and the roll obtained is sawn into individual rolls with the desired width.

It keeps the central hole open by withstanding the internal stresses of the roll and by preventing the internal turns of the winding from collapsing.

It keeps the roll in shape by withstanding the crushing strains along its axis or the transverse crushing strains to which the roll is subjected during transportation or during the various handling operations before it is used.

The tube is generally obtained by winding and adhesively bonding one or more strips of cardboard around a cylindrical form.

Flat cardboard is an inexpensive material which can be composed of recycled fibres. In addition, it is light and its mechanical strength is satisfactory for this use.

However, it exhibits the disadvantage of not being able to be recovered after the roll has been consumed and of becoming a waste product.

In the case of toilet paper, it is not recommended to dispose of the roll by attempting to discharge it with the wastewater as, although composed predominantly of paper fibres, it disintegrates slowly on contact with water and forms a plug before it can be flushed away by the flow.

BRIEF DESCRIPTION OF THE INVENTION

Accordingly, it would be advantageous to produce a roll tube which can be easily discharged with the wastewater from a sanitary installation.

More particularly:

The tube should preferably disintegrate on contact with water.

The material should preferably disintegrate in water at a speed sufficient for it to be discharged before forming a plug; its speed should preferably be of the same order of or close to that of the tissue paper of the roll.

The tube should preferably exhibit a crush resistance, both in the radial direction and in the axial direction, of the same order as that of the cardboard which it is intended to replace.

The tube should be as inexpensive to produce as the cardboard tubes of the prior art.

The tube should be environmentally friendly.

In accordance with an embodiment of the invention, the objectives mentioned above are successfully achieved with a paper sheet which can disintegrate in water with a grammage of between 80 and 400 g/m$^2$, wherein the paper sheet is formed by the dry route from paper fibres bonded to one another by a water-soluble binder comprising starch, the amount of the binder in the sheet being between 30 and 70%.

Dry-route paper is known per se. It is manufactured by depositing a web of paper fibres on a wire. The binder, dissolved in water, is sprayed over the web. The web is subsequently partially dried and calendered. The operation is optionally repeated on each face of the web before final drying.

The starch-based binder is capable of conferring, on the sheet, both dry strength and solubility in water.

In accordance with a specific embodiment, use is made, as water-soluble binder, of a mono-, di- or trisaccharide, preferably sucrose, as a mixture with the starch.

More particularly, the sheet preferably comprises from 40 to 60% by weight of binder.

Another embodiment of the invention is thus a roll tube, the roll being composed of a wound strip of paper or other sheet material, wherein the roll tube is formed of a cylinder, the wall of which comprises at least one dry-route paper sheet comprising paper fibres bonded to one another by a water-soluble binder.

The structure of the tube according to an embodiment of the invention exhibits the advantage of making possible a controlled ability to disintegrate in combination with a strength comparable to that of cardboard.

In accordance with one characteristic, the disintegration time in water of the tube is between 10 and 40 seconds, and preferably between 12 and 20 seconds.

With the aim of producing a disintegrable tube, it is determined that the wall of the cylinder forming the tube has a grammage of between 80 and 400 g/m$^2$ in one or more layers of dry-route paper.

In accordance with another characteristic, the wall of the cylinder is formed of one or more layers of dry-route paper with a unitary thickness of between 0.3 and 2 mm, preferably between 0.4 and 1.2 mm, and more particularly between 0.4 and 0.5 mm.

An embodiment of the invention also relates to the roll formed by winding a strip of paper or other sheet material around a tube as defined above. An embodiment of the invention is targeted in particular at the toilet paper roll.

BRIEF DESCRIPTION OF THE DRAWINGS

An embodiment of the invention is now described in more detail with reference to the drawing of the single FIGURE, which shows an example of a plant for the manufacture of a dry-route paper sheet for producing a tube in accordance with an embodiment of the invention.

DETAILED DESCRIPTION OF THE INVENTION

A web 12 of paper fibres is formed upstream on a permeable endless wire 14 which is positioned between drive rollers. The web is formed by entraining fibres in the dry state in a stream of air which is directed through the wire. Means known per se make it possible to obtain a homogeneous web with the desired grammage over the width of the wire.

One face of the web is treated by application of the water-soluble binder, in particular by means of a spray device 20. The web 12 is optionally compacted downstream by passing between two cylinders not represented here. It is subsequently guided through a first drying station 22, for example with hot air. The web 12, which has thus been strengthened by the at least partial drying of the binder, is turned upside down so as to present its other face under a second binder applicator 24. The wet web is guided through a second drying station 26. The moisture level is reduced in this station without, however, the sheet being completely dried.

It is also possible to provide for the application of additional agents, such as cleaning agents, disinfectants or fragrances. Advantageously, these additives can be applied, by any known means, to the web before or after the second binder applicator.

The final thickness and the final strength of the product are controlled by calendering the sheet resulting here from the second dryer, as is represented in the FIGURE with the cylinders referenced 30 and 32. Insofar as the sheet still exhibits a certain moisture level, the drying thereof is brought to completion downstream of the calender in a drying station 34, which makes it possible to permanently fix the thickness thereof.

The plant can be arranged with alternative forms:

A compactor can be placed between the station for formation of the web on the wire and the first spraying.

A calendering assembly can be positioned between the first dryer and the second spraying station.

The calender can optionally be positioned immediately downstream of the compactor upstream of the first spraying.

The sheet, thus produced continuously, is rolled up 18. This roll is stored while waiting for the sheet thus manufactured to be transformed.

The parameters for the manufacture of the sheet are determined so as to obtain a tube exhibiting the desired properties.

Use is made, for the dry-route paper sheet, of paper fibres preferably with a length of less than 3 mm. The fibres can be fresh or recycled.

The grammage of the web of fibres formed on the forming wire is between 60 and 100 g/m$^2$, preferably 80 g/m$^2$.

Use is preferably made, as water-soluble binder, of starch.

Starch comprises natural products of plant origin, such as wheat, maize, potato, rice, tapioca or sorghum starches, and other starches, composed of polymers or Polysaccharides of high molecular weight. The term "starch" is also understood to mean products derived from natural starch, converted by physical treatment, for example heating, physicochemical treatment or biological treatment, for example enzymatic treatment, and derived or modified starches, such as cationic, anionic, amphoteric, nonionic or crosslinked starches, and the products resulting from the hydrolysis of starch, such as maltodextrins.

Starch is the preferred binder but the invention also comprises the use of other binders with the starch which also exhibit properties of solubility in water, such as a water-soluble latex. The invention also comprises the use of a monosaccharide, such as glucose or fructose, or of a disaccharide, such as sucrose, or of a trisaccharide, such as raffinose, as a mixture with the starch.

The binder is advantageously coloured in order to make possible control of the good distribution thereof over the two faces.

In the case of starch, the binder is applied by spraying a solution in water comprising from 20 to 40% by weight thereof.

Preferably, the concentration is as high as possible in order to reduce the amount of water to be removed.

The amount deposited is between 35 and 150 g/m$^2$.

The calendered sheet resulting from the machine exhibits a thickness of between 0.3 and 2 mm and preferably of between 0.4 and 1.2 mm.

An example of the manufacture of the tube consists in cutting up the dry-route paper sheet into one or more thin strips. The strip or strips are helically wound around a cylindrical form. An adhesive is applied to the parts of the turns which are superimposed in order to bond them to one another and to form a tubular member.

It was possible to manufacture tubes according to an embodiment of the invention having a flat crush resistance substantially equal to that of a similar tube made of standard cardboard of the prior art.

Given that the main stresses experienced by the tube during its cycle of production and of distribution are essentially exerted under flat crush conditions, it may be considered that the tube of the invention fully meets the requirements in this respect.

It has been found that a tube according to an embodiment of the invention disintegrated more rapidly than a similar standard tube of the prior art. The term "similar tube" is understood to mean a standard tube having substantially the same diameter and the same length as the tube of the invention.

It has been found that a tube according to an embodiment of the invention disintegrates more rapidly, in the AFNOR NF Q34-020 test, than a standard tube of the prior art with a weight of 400 g/m$^2$ formed of two thicknesses or two plies of flat cardboard. Such a standard tube of the prior art completely disintegrates only after 10 minutes, with residual pieces of cardboard. The turns become detached after 30/60 seconds and the cardboard begins to disintegrate after 3 minutes.

The invention claimed is:

1. A roll tube composed of a wound strip of sheet material, the roll tube comprising:

a cylinder, a wall of the cylinder comprising at least one dry-route paper sheet comprising paper fibres bonded to one another by a water-soluble binder comprising starch, the amount of the binder in the sheet being between 30 and 70% by weight.

2. The roll tube according to claim 1, wherein a disintegration time of the roll tube in water is between 10 and 40 seconds.

3. The roll tube according to claim 1, wherein the roll tube is formed solely of dry-route paper.

4. The roll tube according to claim 1, wherein the wall of the cylinder is made of one or more layers of dry-route paper.

5. The roll tube according to claim 1, wherein the wall of the cylinder is formed of one or more layers of dry-route paper with a unitary thickness of between 0.3 and 2 mm.

6. The roll tube according to claim 1, wherein the binder further comprises sucrose.

7. The roll tube according to claim 2, wherein the disintegration time of the roll tube in water is between 12 and 20 seconds.

8. The roll tube according to claim 5, wherein the wall of the cylinder is formed of one or more layers of dry-route paper with a unitary thickness of between 0.4 and 1.2 mm.

9. A roll formed by winding a strip of sheet material around a tube, the roll comprising:

a cylinder, a wall of the cylinder comprising at least one dry-route paper sheet comprising paper fibres bonded to one another by a water-soluble binder comprising starch, the amount of the binder in the sheet being between 30 and 70% by weight.

10. A roll according to claim 9, wherein the sheet material is cellulose wadding.

* * * * *